US005562413A

United States Patent [19]

Aihara et al.

[11] Patent Number: 5,562,413

[45] Date of Patent: Oct. 8, 1996

[54] VARIABLE PROPELLER FOR BOAT

[75] Inventors: Takao Aihara; Taro Fukuda; Hideaki Takada; Ikuo Nakazato, all of Wako, Japan

[73] Assignee: Honda Giken Kogyo Kabushiki Kaisha, Tokyo, Japan

[21] Appl. No.: 364,205

[22] Filed: Dec. 27, 1994

[30] Foreign Application Priority Data

| | | | |
|---|---|---|---|
| Dec. 27, 1993 | [JP] | Japan | 5-333509 |
| Dec. 27, 1993 | [JP] | Japan | 5-333510 |
| Dec. 28, 1993 | [JP] | Japan | 5-338038 |
| Nov. 18, 1994 | [JP] | Japan | 6-285628 |

[51] Int. Cl.[6] ..... B63H 1/22

[52] U.S. Cl. ..... 416/87; 416/93 A; 416/143

[58] Field of Search ..... 416/87, 93 A, 416/134 R, 135, 143

[56] References Cited

U.S. PATENT DOCUMENTS

| | | | |
|---|---|---|---|
| 2,134,660 | 10/1938 | Everts | 416/143 |
| 2,504,737 | 4/1950 | Sharpes | 416/135 |
| 3,565,544 | 2/1971 | Marshall | 416/143 |
| 4,744,727 | 5/1988 | Muller | 416/93 A |
| 5,252,028 | 10/1993 | LoBosco et al. | 416/93 A |

*Primary Examiner*—Edward K. Look
*Assistant Examiner*—Mark Sgantzos
*Attorney, Agent, or Firm*—Nikaido, Marmelstein, Murray & Oram LLP

[57] ABSTRACT

A plurality of blade shafts spline-connected to bosses of a plurality of propeller blades are rotatably carried on a propeller boss parallel to the axis of the boss, the propeller blades being rotated so as to increase the propeller-diameter D according to an increase in the centrifugal force, and all the blade shafts are mutually connected through a synchronizer including cranks integrally continuously provided on the blade shafts and a single common synchronizing ring. With this arrangement, it is possible to always equally control opening angles of all the propeller blades despite any partial conditional change.

11 Claims, 17 Drawing Sheets

VARIABLE PROPELLER FOR BOAT

BACKGROUND OF THE INVENTION

1. Field of the Invention

The present invention relates to a variable propeller for a boat in which a propeller boss is fitted and connected to a propeller shaft, and a plurality of propeller blades are rotatably mounted to the propeller boss through a plurality of blade shafts disposed to surround an axis of the propeller boss and along the axis thereof so as to effectively vary a propeller-diameter.

2. Description of the Prior Art

Such a variable propeller as described above has been already known as disclosed, for example, in U.S. Pat. No. 3,565,544. The variable propeller disclosed in the above mentioned patent has independent propeller blades and is rotated so as to vary the propeller-diameter by the balance between the centrifugal force exerting thereon and the drag of water. In the above proposal, however, due to partial conditional changes during cruising, for example, a partial cavitation caused during cruising in shallows and during a sudden turning movement, opening angles of flange blades become uneven or the opening angles are repetitively increased or decreased to impair the smoothness of rotation of the propeller.

The present invention has been achieved in view of the above circumstances, and it is an object of the present invention to provide a variable propeller which can always equally control all the propeller blades while making use of the centrifugal force despite the partial conditional changes during cruising to precisely adjust the propeller-diameter.

SUMMARY OF THE INVENTION

To achieve the above object, according to a first feature of the present invention, there is provided a variable propeller for a boat, comprising: a propeller boss fitted and connected to a propeller shaft; a plurality of blade shafts disposed along an axis of the propeller boss so as to surround the axis; and a plurality of propeller blades rotatably mounted to the propeller boss through the blade shafts so as to vary a propeller-diameter, wherein bosses for the plurality of propeller blades are connected to the plurality of blade shafts rotatably carried on the propeller boss, the propeller blades are arranged to rotate along with the blade shafts to increase the propeller-diameter in response to an increase in a centrifugal force exerting on the propeller blades, and all the blade shafts are mutually synchronously interlocked through a synchronizer comprising a crank continuously provided on one end of each of the blade shafts and a common synchronizing ring carried on the propeller boss such that the ring is engaged with a crank pin of each of the cranks to rotate about the axis of the propeller boss.

With the first feature, it is possible to always equally control the opening angles of all the propeller blades despite any partial conditional changes to secure a smooth rotating state of the propeller.

According to a second feature of the present invention, in addition to the first feature, the variable propeller further comprises a return spring connected to the synchronizing ring for rotationally biasing the plurality of propeller blades in their closed direction in which the propeller-diameter is reduced, and wherein an engaging point between the synchronizing ring and the crank pin is arranged to separate away from a straight line connecting a center of the synchronizing ring and a center of the blade shaft in accordance with an increase in an opened angle of the propeller blade.

With the second feature, when the opened angle of the propeller blade increases, trend in increase of torque in the opened direction of the propeller blade caused by the centrifugal force matches a trend in increase of torque in the closed direction of the propeller blade caused by the load of the return spring, and the propeller-diameter can be precisely increased according to an increase in the number of revolutions of the propeller to improve the output performance.

According to a third feature of the present invention, in addition to the second feature, the synchronizing ring is provided with a set load adjusting means for adjusting a set load of the return spring.

With the third feature, time for starting the opening of all the propeller blades can be suitably set, and accordingly, the adjustment or change of propeller characteristics can be easily accomplished without replacing the return spring.

According to a fourth feature of the present invention, in addition to the third feature, the return spring comprises a torsional coil spring; and a coil portion of the torsional coil spring is disposed coaxially with the synchronizing ring, and both ends of the torsional coil spring are locked at the propeller boss and the synchronizing ring, respectively.

With the fourth feature, the spring constant of the return spring can be suitably selected in a wide range by selecting a coil-diameter, a of number coil-windings and a wire-diameter of the return spring. Accordingly, various kinds of propellers different in characteristics can be easily produced, and in addition, it is possible to always impart to the propeller blades the stabilized torque in the closing direction through the synchronizing ring.

According to a fifth feature of the present invention, in addition to the fourth feature, the synchronizing ring is provided at different peripheral positions thereof with a plurality of lock portions capable of engaging with the return spring.

With the fifth feature, by a simple operation to change the stop position of the return spring relative to the synchronizing ring, it is possible to adjust the set load of the return spring and, thus, the time for starting the opening of the propeller blades.

Further, according to a sixth feature of the present invention, in addition to the first, second, third, fourth or fifth features, a torque limiting device which produces a slipping upon receiving a rotational torque equal to or more than a predetermined value is interposed between the propeller shaft and the propeller boss.

With the sixth feature, if an obstacle strikes on a certain propeller blade, the force of shock of the obstacle dispersed to all is other propeller blades through the synchronizer, and the force of shock is absorbed by the operation of the torque limiting device. As a result, it is possible to effectively protect various parts of the propeller and a power transmission system from the force of shock.

Further, according to a seventh feature of the present invention, in addition to the first, second, third, fourth, fifth or sixth features, a recess for accommodating the boss for each of propeller blade is formed in an outer periphery of the propeller boss, both front and rear ends of the blade shaft for supporting the boss are carried by front and rear bearing holes provided in front and rear end walls of the recess, each of the blade shafts is formed with a flange opposed to one of axially opposite end surfaces of the propeller boss, and a common retaining plate for retaining each of the flanges in a sandwiching manner between the retaining plate and the one end surface of the propeller boss is fixedly mounted to the propeller boss.

With the seventh feature, it is possible to precisely retain all the blade shafts in a predetermined axial position by means of the single retaining plate without requiring a high accuracy in the depth of the bearing hole on the other side of the propeller boss. The retaining construction of the retaining plate is simple, and a good assembling property can be obtained.

Furthermore, according to an eighth feature of the present invention, in addition to the seventh feature, a retaining plate is fixedly mounted to the propeller boss by means of a detachable fixing member.

With the eighth feature, if the fixing member is removed, all the blade shafts and propeller blades can be removed. It is possible to easily carry out the maintenance such as replacement of propeller blades.

Moreover, according to a ninth feature of the present invention, in addition to the seventh or eighth feature, the propeller boss comprises a boss body having the recesses and the front and rear bearing holes to support the blade shafts and a diffuser pipe fitted to a rear end of the boss body, and the retaining plate is fixedly mounted to the boss body by a common fixing member along with a mounting plate fixedly mounted on the diffuser pipe.

With the ninth feature, the retaining plate can be fixedly mounted simultaneously with the mounting of the diffuser pipe, and the construction and the assembling property can be further simplified.

Further, according to a tenth feature of the present invention, there is provided a variable propeller for a boat, comprising: a propeller boss fitted and connected to a propeller shaft; a plurality of blade shafts disposed along an axis of the propeller boss so as to surround the axis; and a plurality of propeller blades rotatably mounted to the propeller boss through the blade shafts so as to vary a propeller-diameter, wherein bosses for the plurality of propeller blades are connected to the plurality of blade shafts rotatably carried on the propeller boss, the propeller blades are arranged to rotate along with the blade shafts to increase the propeller-diameter in response to an increase in the centrifugal force exerting on the propeller blades, all the blade shafts are synchronously interlocked by a synchronizer, and a common return spring for biasing each of the blade shafts in a direction to reduce the propeller-diameter is connected to the synchronizer.

With the tenth feature, it is possible to automatically control the propeller-diameter according to a rotational speed of the propeller boss by the balance between the centrifugal force of each of the propeller blades and the repulsion force of the return spring, and accordingly, a special actuator is not necessary. Further, since the force of the return spring exerts on all the propeller blades through the synchronizer, a single common return spring suffices for all the propeller blades and an actuator is unnecessary, thus enabling the simplification of the construction and reduction in cost. In addition, since all the propeller blades are mutually and equally defined in their rotational angles by the synchronizer, it is possible to eliminate the influence of difference in individuality between the propeller blades to always exhibit the stabilized propeller performance.

Moreover, according to an eleventh feature of the present invention, in addition to the tenth feature, a rear end portion of the propeller boss is formed with a diffuser pipe, and a hollow portion of the diffuser pipe comprises a synchronizer chamber for accommodating the synchronizer and the return spring.

With the eleventh feature, it is possible to protect the synchronizer and the return spring from impingement with obstacles. A protective cover exclusively used therefor is not necessary.

The above and other objects, features and advantages of the present invention will become apparent from ensuing preferred embodiments with reference to accompanying drawings.

BRIEF DESCRIPTION OF THE DRAWINGS

FIGS. 1 to 11 illustrates a first embodiment of the present invention, wherein FIG. 1 is a partially vertical sectional view of an essential portion of a propelling device for a boat provided with a variable propeller;

FIG. 2 is an enlarged vertical sectional view of a propeller portion shown in FIG. 1;

FIG. 3 is a sectional view taken along a line 3—3 in FIG. 2;

FIG. 4 is a sectional view taken along a line 4—4 in FIG. 2;

FIG. 5 is a sectional view similar to FIG. 4 with some parts removed;

FIG. 6 is a view taken along an arrow 6 in FIG. 2; and

FIG. 7 is an exploded perspective view of an essential portion of the propeller;

FIG. 8 is an enlarged cross-sectional view corresponding to FIG. 4 showing a synchronizer in a state where propeller blades are closed;

FIG. 9 is a similar cross-sectional view showing a synchronizer in a state where propeller blades are opened;

FIG. 10 is a geometric schematic view of the synchronizer; and

FIG. 11 is a characteristic curve of the synchronizer.

DESCRIPTION OF THE PREFERRED EMBODIMENTS

The present invention will now be described by way of preferred embodiments in connection with the accompanying drawings.

Figure 1:
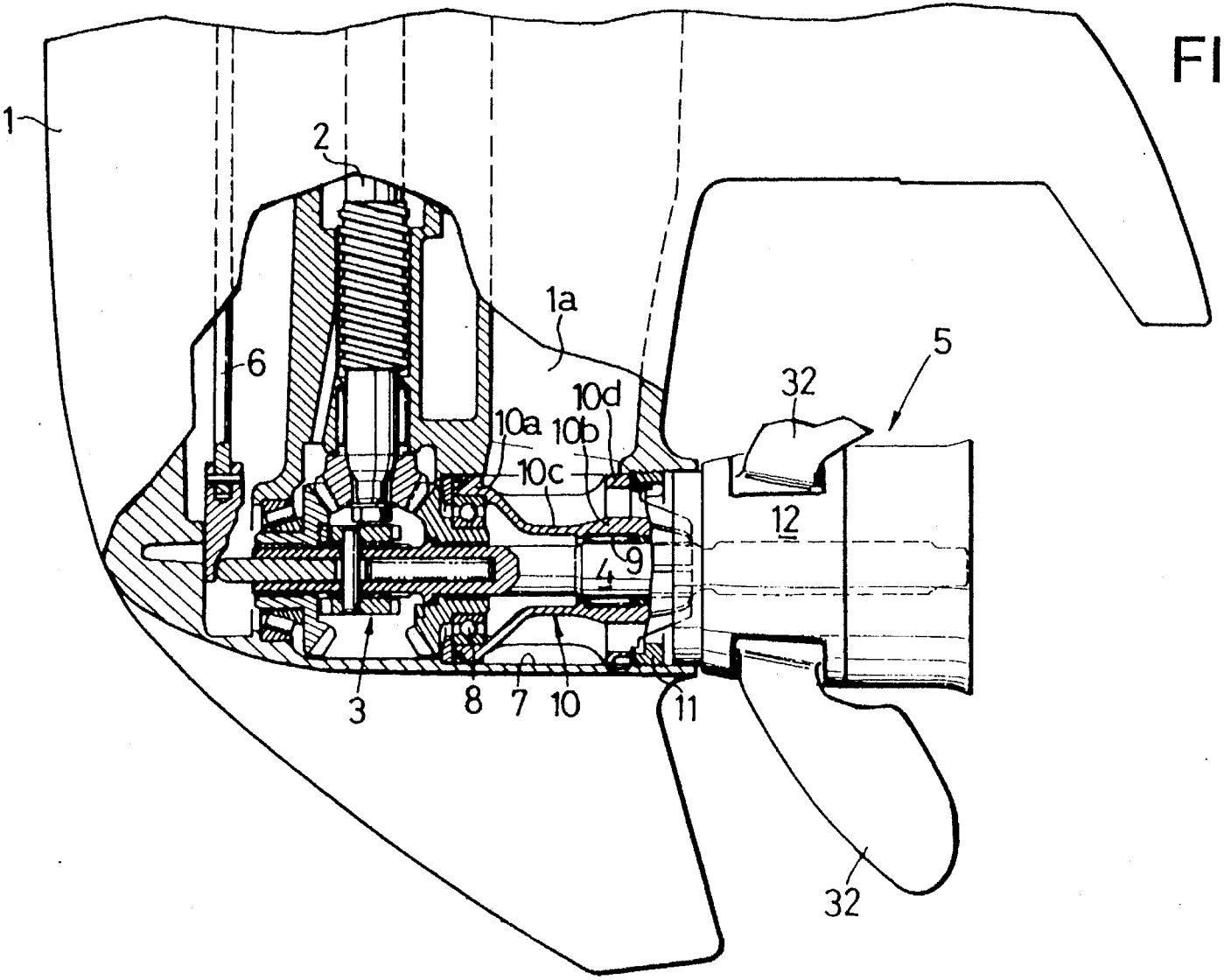

A first embodiment shown in FIGS. 1 to 11 will be first described. Referring to FIG. 1, carried on a body of a propelling device 1 of an outboard motor mounted on transom of a ship or boat are a vertically-disposed driving shaft 2 driven from an engine, (not shown), and a horizontally-disposed propeller shaft 4 connected to the driving shaft 2 through a gear mechanism 3. A variable-diameter type propeller 5 is mounted on a portion of the propeller shaft 4 projected rearwardly from the body of the propelling device 1.

The gear mechanism 3 is of a known bevel gear type and is switchable between a forward mode capable of driving the propeller shaft 4 in a forward direction and a backward mode capable of driving the propeller shaft 4 in a backward direction.

Figure 2:
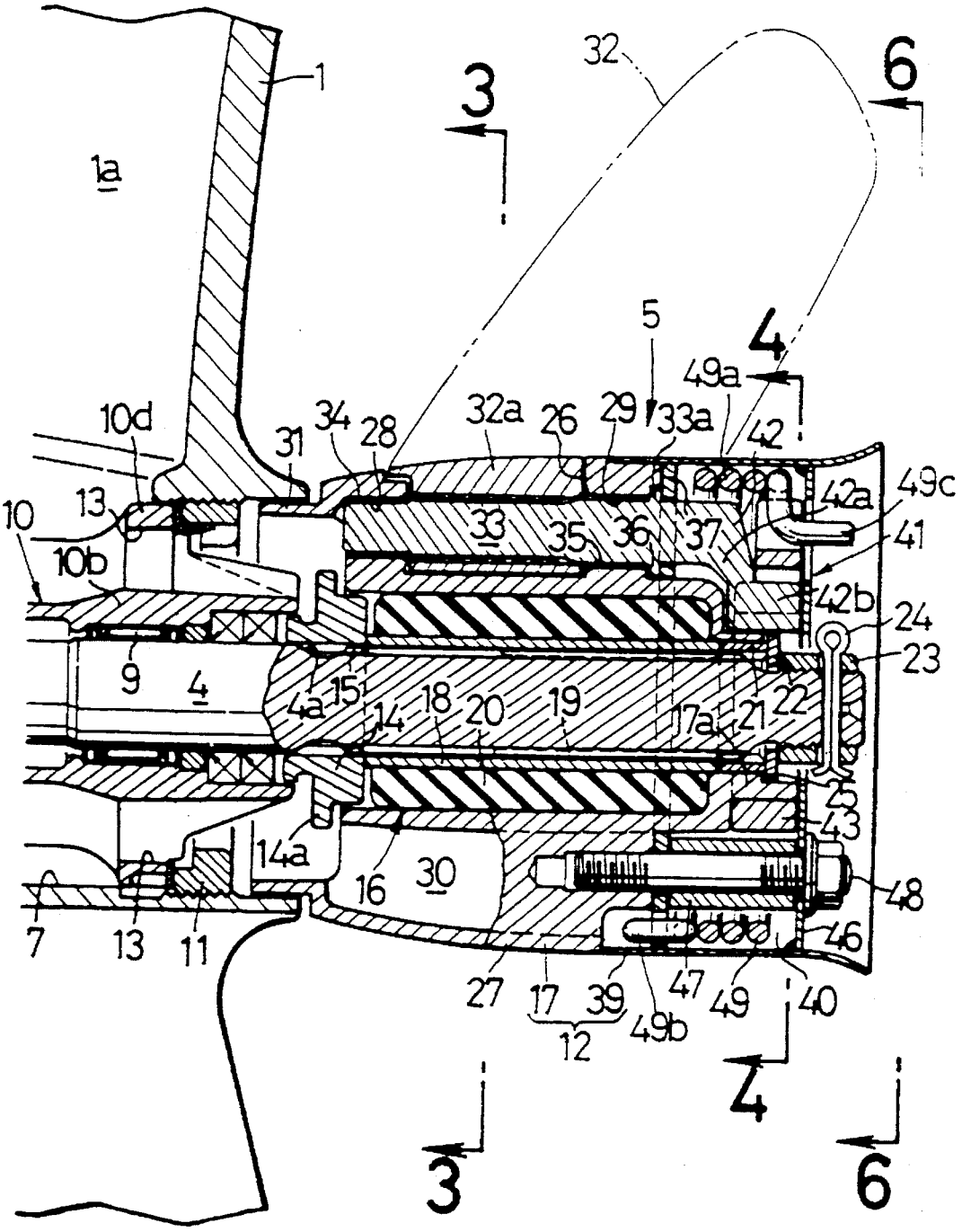

Referring to FIGS. 1 and 2, a bearing holder 10 for holding a pair of front and rear bearings 8 and 9 used for carrying the propeller shaft 4 is fitted in a mounting hole 7 opened in a rear surface of the body of the propelling device 1. A ring nut 11 is also threadingly fitted in the mounting hole 7 for pressing the bearing holder 10 from the rear. The bearing holder 10 includes a larger-diameter sleeve portion 10*a* for holding the front ball bearing 8, and a smaller-diameter sleeve portion 10*b* for holding the rear needle bearing 9. Both the sleeve portions 10*a* and 10*b* are integrally connected to each other through a tapered sleeve portion 10*c*. A flange 10*d* is integrally formed on the smaller-diameter portion 10*b* to project from an outer peripheral surface thereof and is retained by the ring nut 11. A plurality of exhaust outlets 13 are provided in the flange 10*d* to communicate with an exhaust port of the engine through a hollow portion la in the body of the propelling device 1.

The construction of the variable-diameter type propeller 5 will be described in connection with FIGS. 2 to 7.

Referring to FIG. 2, a thrust ring 14 is fitted through a spline 15 over the propeller shaft 4 adjacent a rear end of the bearing holder 10. The thrust ring 14 is prevented from being moved forward by abutting against a tapered surface 4*a* of the propeller shaft 4.

In the rear of the thrust ring 14, a boss body 17 of a propeller boss 12 is connected to the propeller shaft 4 through a torque limiting device 16. The torque limiting device 16 and the boss body 17 are disposed in a concentrically superposed relation about the propeller shaft 4.

The torque limiting device 16 includes a sleeve 18 detachably fitted over the propeller shaft 4 through a spline 19, and a damper rubber 20 baked to an outer peripheral surface of the sleeve 18 is press-fitted to an inner peripheral surface of the boss body 17. The damper rubber 20 is connected to the boss body 17 with a predetermined frictional force, so that if a rotational torque equal to or more than a predetermined value is received, a slipping is produced between the damper rubber 20 and the boss body 17.

An extension collar 21 is spline-fitted over the propeller shaft 4 to abut against a rear end of the sleeve 18. A nut 23 is threadingly fitted over a rear end of the propeller shaft 4 for retaining a rear end of the extension collar 21 through a thrust washer having a diameter larger than that of the extension collar 21. An anti-loosing cotter pin 24 is inserted into the nut 23 and the propeller shaft 4. The extension collar 21 and the sleeve 18 may be formed integrally with each other.

The boss body 17 includes a positioning boss 17*a* projecting rearward from an end face covering a rear end of the damper rubber 20 and rotatably fitted over the extension collar 21, whereby the concentric position of the boss body 17 relative to the propeller shaft 4 is maintained. The positioning boss 17*a* is formed into a cylindrical shape to surround the thrust washer 22. The boss 17*a* is provided at its inner peripheral surface with a shoulder 25 which is opposed to a front surface of the thrust washer 22. A rearward thrust applied to the boss body 17 is received by the thrust washer 22 through the shoulder 25. In this case, a flange may be formed around an outer periphery of a rear end of the extension collar 21 and may be put into abutment against the shoulder 25.

A front end face of the boss body 17 is opposed to a flange 14*a* formed around the outer periphery of the thrust ring 14, so that a forward thrust applied to the boss body 17 is received by the flange 14*a*.

Figure 3:
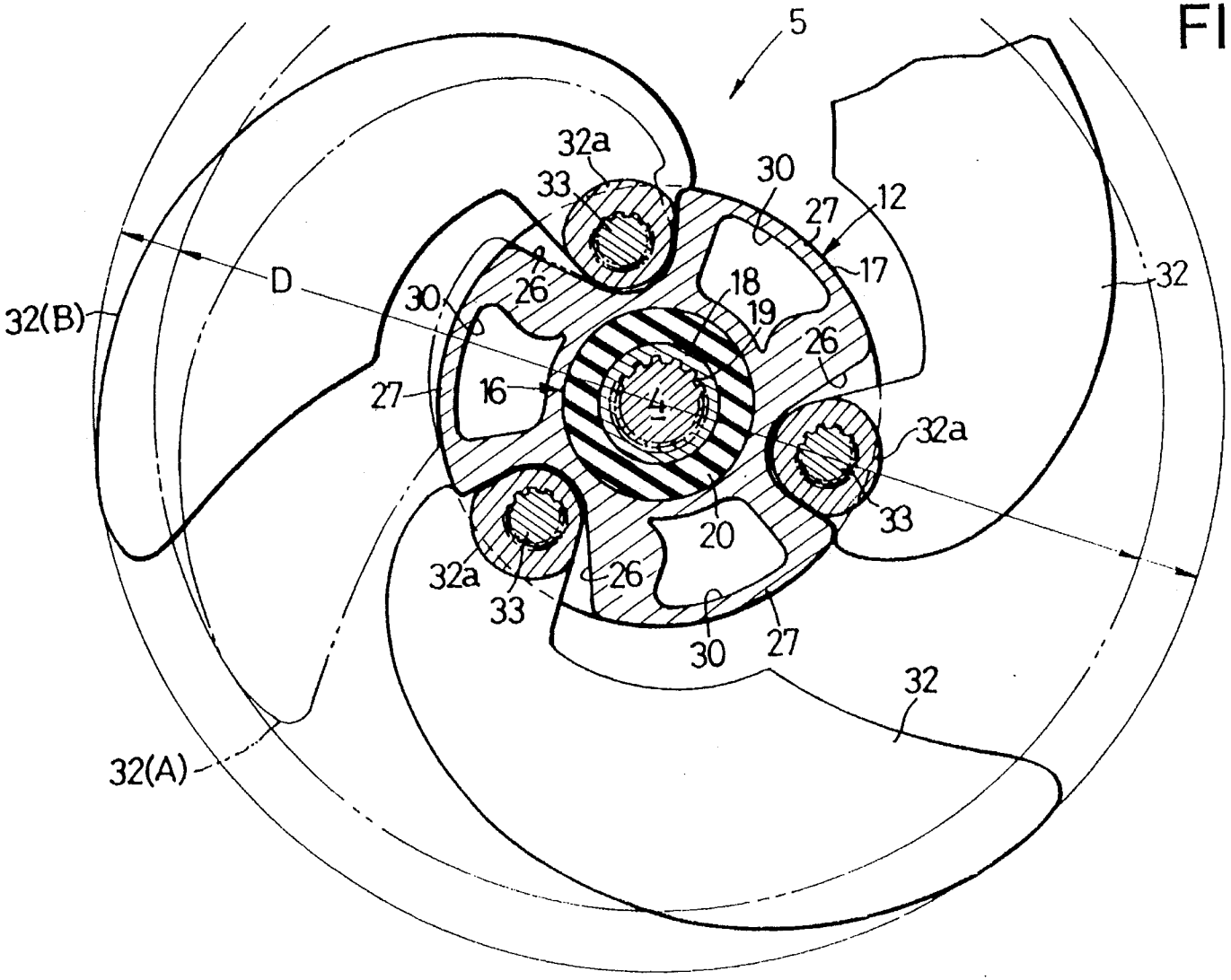
Figure 4:
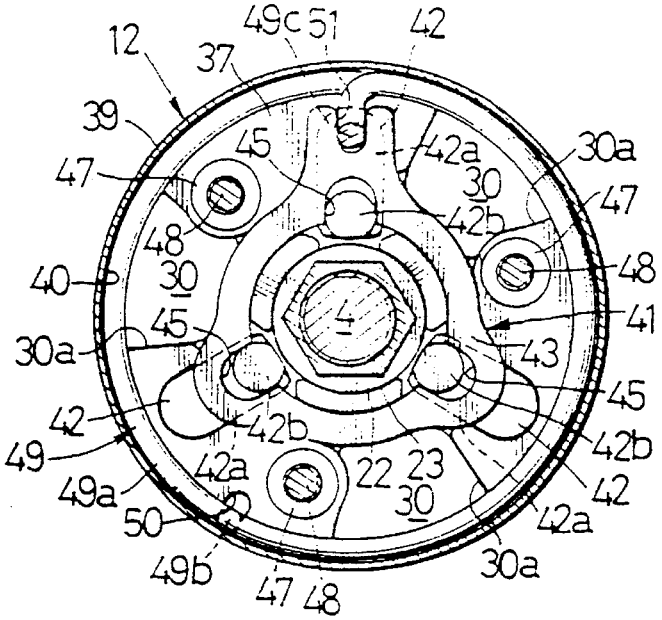
Figure 5:
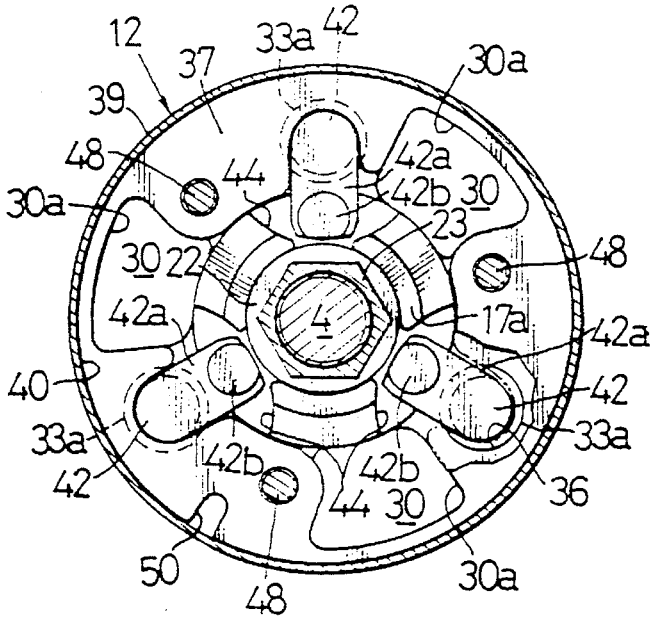

Referring to FIGS. 2 and 3, provided in the boss body 17 are three recesses 26 opened at an outer peripheral surface of the boss body 17 and arranged circumferentially at equal distances with its bottom surface located in proximity to an outer peripheral surface of the damper rubber 20, a pair of bearing holes 28 and 29 opened at longitudinally opposite end walls of each of the recesses 26, three exhaust passages 30 each extending axially through a land portion 27 sandwiched between the adjacent recesses 26, and cylindrical recess 31 permitting the communication between the exhaust passages 30 and the exhaust outlet 13. The cylindrical recess 31 is rotatably inserted in a rear opening of the mounting hole 7.

The boss 32*a* of a propeller blade 32 is accommodated in each of the recesses 26 in the boss body 17. A blade shaft 33 spline-fitted over the boss 32*a* is rotatably carried at longitudinally opposite ends of the shaft 33 in the bearing holes 28 and 29 with bushes 34 and 35 of a synthetic resin interposed therebetween, respectively. In this manner, the three blade shafts 33 are disposed in parallel to the propeller shaft 4 to surround the latter.

Each of the blade shafts 33 is provided with a flange 33*a* which is rotatably accommodated in the circular recess 36 defined in the rear opening of the rear bearing hole 29. A retaining plate 37 common for the blade shafts 33 for retaining the flanges 33*a* from the rearward to fix the axial positions of the blade shafts is secured to a rear end face of the propeller boss 12 by a bolt 48 which will be described hereinafter. The retaining plate 37 is provided with an exhaust passage 30*a* aligned with the exhaust passages 30.

Each of the propeller blades 32 is rotatable along with the blade shaft 33 between a closed position A to provide a minimum diameter D of the propeller and an opened position B to provide a maximum diameter D of the propeller. The closed and opened positioned A and B are limited by abutment of the propeller blade 32 against and inner wall of the recess 26.

Figure 6:
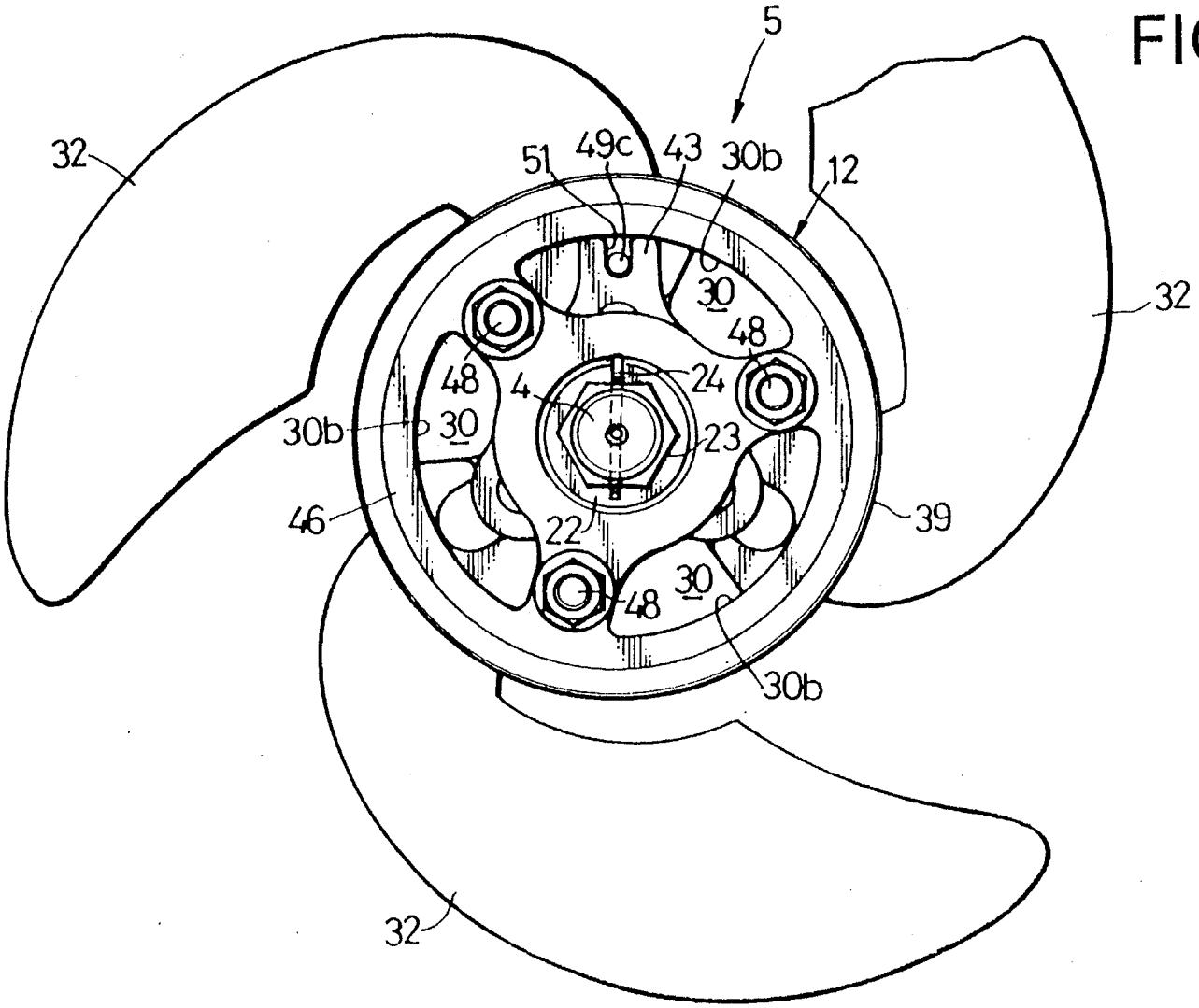
Figure 7:
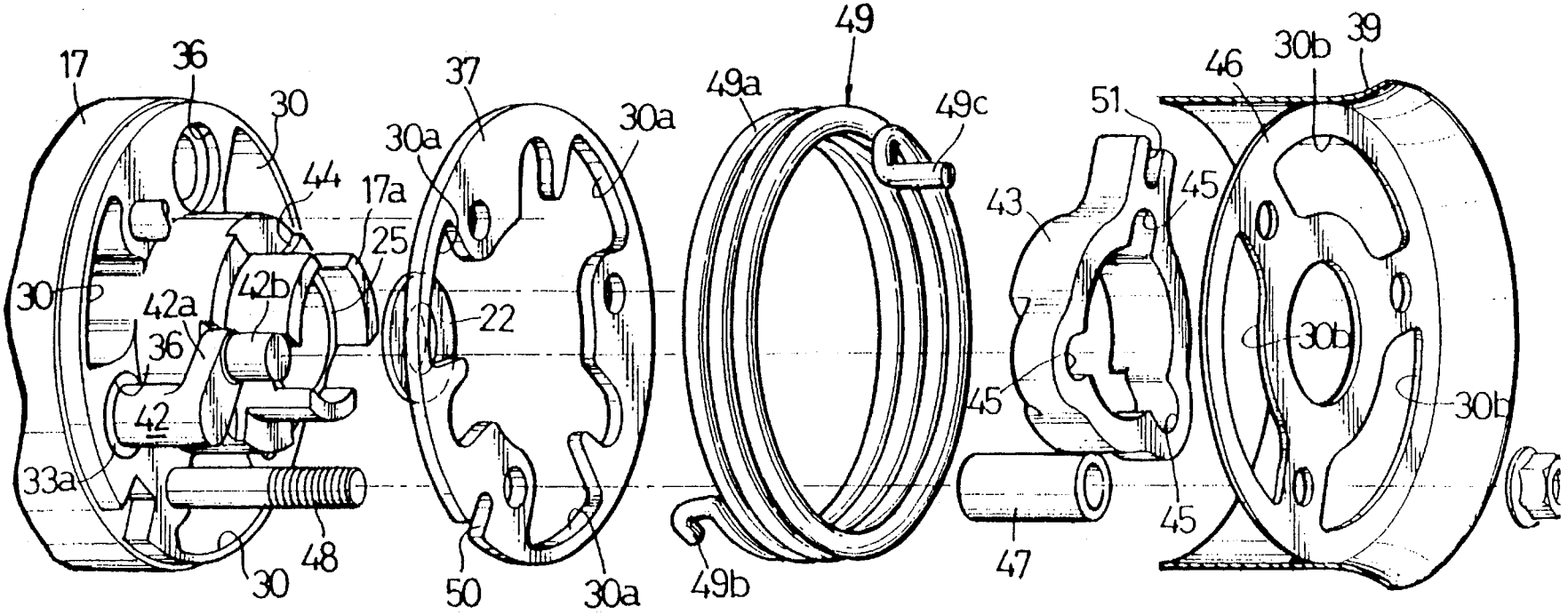

As shown in FIGS. 2, 6 and 7, the propeller boss 12 is constructed by fitting a diffuser pipe 39 of a small wall thickness to the rear end of the boss body 17 in such a manner that outer peripheral surfaces of both the pipe 39 and boss body 17 are flush with or continuous to each other. A mounting plate 46 is welded to an inner peripheral wall of the diffuser pipe 39 and secured to the rear end face of the boss body 17 by a bolt 48 in a manner to sandwich a distance collar 47 and the retaining plate 37. The mounting plate 46 is provided with exhaust holes 30*b* at locations corresponding to the exhaust passages 30. The mounting plate 46 is disposed to define a synchronizer chamber 40 between the mounting plate 46 itself and the rear end face of the boss body 17. A synchronizer 41 is formed in the synchronizer chamber 40 for synchronously interlocking all the propeller blades 32 with one another.

More specifically, as shown in FIGS. 2, 4, 5 and 7, the synchronizer 41 includes cranks 42 integrally and continuously formed to the rear ends of the blade shafts 33, and a single synchronizing ring 43 rotatably carried around the outer periphery of the positioning boss 17*a*. A rear surface of the ring 43 is retained by the mounting plate 46 of the diffuser pipe 39, so that it is prevented from being removed from the positioning boss 17*a*.

The crank 42 has a crank arm 42*a* bent from the blade shaft 33 toward the propeller shaft 4, and a crank pin 42*b* is provided at a tip end of the crank arm 42*a* and swingably received in a circular cutout 44 made around the outer periphery of the positioning boss 17*a*. The synchronizing ring 143 is provided with three U-shaped engage grooves 45 opened at their inner peripheral surfaces, and the crank pins 42*b* are slidably received in the engage grooves 45, respectively. The synchronizing ring 43 is formed into a substantially triangular contour, so that it does not cover the three exhaust passages 30 from the rearward. Thus, all the blade shafts 33 can be rotated synchronously by limiting the rotational angles with one another through the respective corresponding cranks 42 and the common synchronizing ring 43.

A return spring 49 is contained in the synchronizer chamber 40 for biasing all the propeller blades 32 for rotation toward the closed positions A via the synchronizer 41. The return spring 49 includes a torsion coiled spring and has a coiled portion 49*a* which is disposed along the inner peripheral surface of the diffuser pipe 39 to surround all the cranks 42. Locking claws 49*b* and 49*c* are formed at front and rear opposite ends of the coiled portion 49*a* and engaged in engage grooves 50 and 51 formed in the retaining plate 37 and the synchronizing ring 43, respectively.

If the propeller shaft 4 is driven from the driving shaft 2 through the gear mechanism 3, the driving torque thereof is transmitted through the sleeve 18 and the damper rubber 20 to the propeller boss 12, and further from the blade shafts 33 to the propeller blades 32. Therefore, the propeller blades 32 are rotated along with the propeller boss 12 to generate a thrust.

In the low speed rotational region of the propeller boss 12, all the propeller blades 32 are retailed at the closed position A through the synchronizer 41 by the force of the return spring 49 to minimize the propeller diameter D. Therefore, the thrust generated is relatively small, and trawling can be easily effected.

Thereafter, as the rotational speed of the propeller boss 12 increases beyond a given value, all the propeller blades 32 open until the centrifugal force acting thereto is balanced with the drag of water and the repulsion force of the return spring 49. When the rotational speed of the propeller boss 12 enters a predetermined high speed rotational region, all the propeller blades 32 reach the maximum opened position B to maximize the propeller diameter D. Therefore, a great thrust is generated to enable high-speed cruising.

Since all the propeller blades 32 are interlocked with one another by the synchronizer 41 as mentioned previously, unevenness of the opened angle caused by the difference in the centrifugal force acting on each of the propeller blades 32, the drag of water and other external causes can be eliminated to always stabilize the performance of the propeller 5.

When small obstacles such as floating things strike on the propeller blades 32 during cruising, the force of shock is dispersed to all the propeller blades 32 through the synchronizer 41 so that a torsional deformation is generated in the damper rubber 20 to reduce the force of shock applied to the propeller blades 32. Further, when a large obstacle and a rock strikes on the propeller blades 32, a slipping is produced between the damper rubber 20 and the boss body 17*a*. In such case, the propeller shaft 4 runs idle relative to the propeller boss 12 so that overloads of various parts of the propeller 5 and of the power transmission system can be shut out.

An exhaust gas from the engine (not shown) is discharged to the hollow la of the body of the propelling device 1. The exhaust gas is discharged through the exhaust outlet 13 of the bearing holder 10 into the cylindrical portion 31 of the boss body 17, and diverted therefrom into the three exhaust passages 30 and then, sequentially through the exhaust hole 30*a* in the retaining plate 37, the synchronizer chamber 40, and the exhaust passage 30*b* in the mounting plate 46, i.e., through the diffuser pipe 39 into the water. As described above, the delivery of the exhaust gas from the body of the propelling device 1 to the three exhaust passages 30 of the boss body 17 is carried out within the cylindrical portion 31 at the front end of the boss body 17. Therefore, the exhaust gas to the three exhaust passages 30 can be equally distributed.

Furthermore, each of the exhaust passages 30 is formed so as to pass the land portion 27 of the boss body 17, i.e., between the three recesses 26 for accommodating the boss 32*a* of the propeller blades 32. Therefore, it is possible to secure a necessary and sufficient sectional area without being obstructed by the boss 32*a* and the blade shaft 33 for supporting thereof and without being accompanied by an increase in diameter of the propeller boss 12, thus contributing to the reduction in exhaust resistance as well as the equal distribution of the exhaust gas.

On the other hand, the blade shaft 33 can be supported at both ends thereof by a pair of front and rear bearing holes 28 and 29 without being obstructed by the exhaust passages 30 to firmly support the propeller blades 32.

Since the damper rubber 20 of the torque limiting device 16 is disposed in the concentrically superposed relation to the boss body 17, the boss body 17 can be formed into an axial length substantially equal to that of a usual propeller having stationary blades. Therefore, it is possible to attach the boss body 17 to a relatively short propeller shaft to which the usual propeller has been conventionally attached. Moreover, since the propeller blade 32 is formed into a variable-diameter type with its boss 32*a* accommodated in the recess 26 in the outer peripheral surface of the boss body 17 and supported by the blade shaft 33 parallel to the propeller shaft 4, it is possible to inhibit a maximum increase in diameter of the boss body 17, while sufficiently insuring the capacity of the torque limiting device.

In the synchronizer 41, the crank arm 42*a* is bent from the rear end of the blade shaft 33 toward the propeller shaft 4, and the crank pin 42*b* is received in the cutout 44 provided around the outer periphery of the positioning boss 17 and is further engaged by the synchronizing ring 43, as described above. Therefore, it is possible to achieve reduction in diameter of the synchronizing ring 43 and a compactness of the entire synchronizer 41, and to easily accommodate the synchronizer 41 in the narrow synchronizer chamber 40 within the diffuser pipe 39.

Further, since the common return spring 49 for biasing the synchronizing ring 43 in a direction to close all the propeller blades 32 while surrounding the crank arm 42*b* is contained in the synchronizer chamber 40, the single return spring 49 need only be required for all the propeller blades 32 and moreover, the return spring 49 is protected against an obstacle, along with the synchronizer 41.

Next, the setting of the relative position between each of the cranks 42 and the synchronizing ring 43 of the synchronizer 41 will be described.

Figure 8:
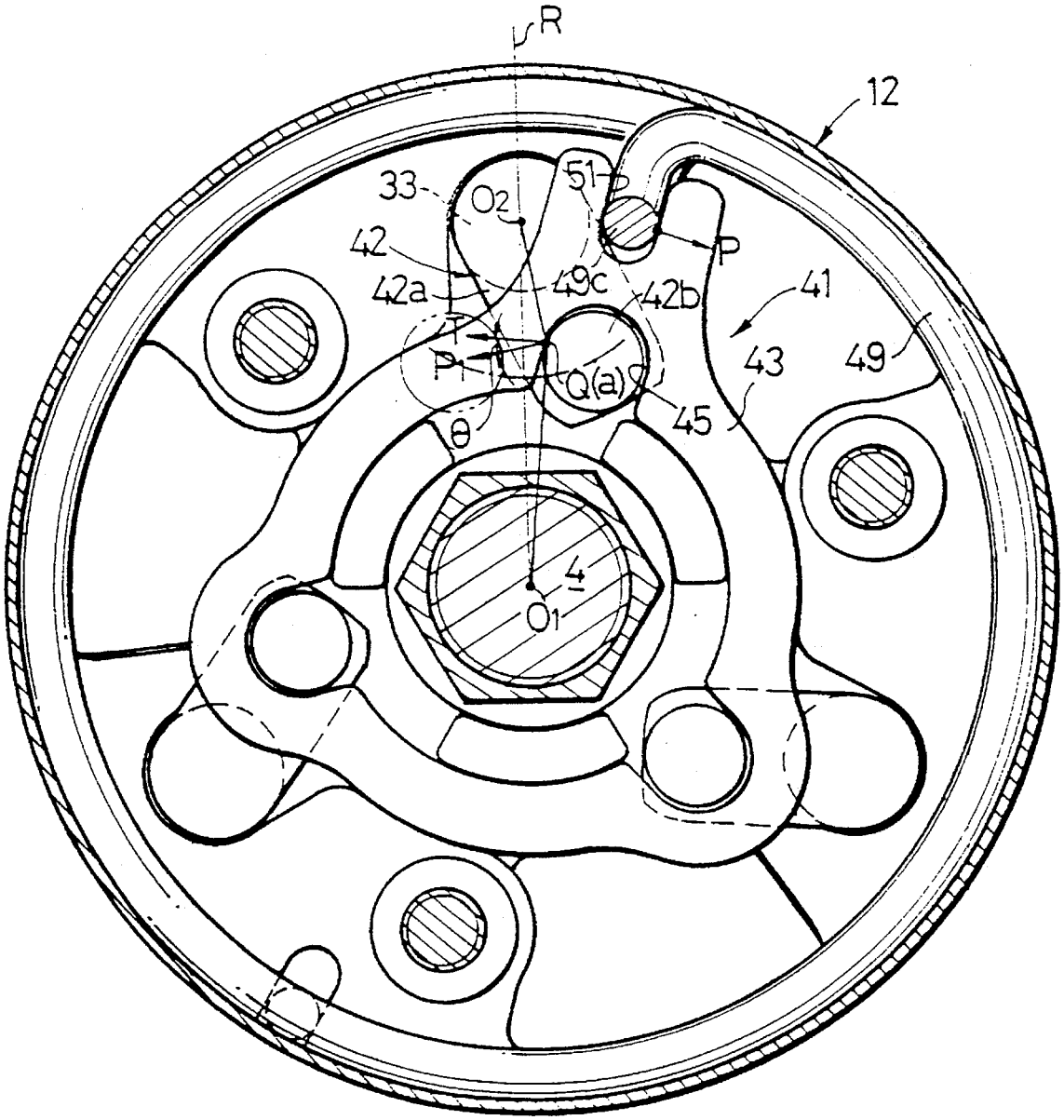
Figure 9:
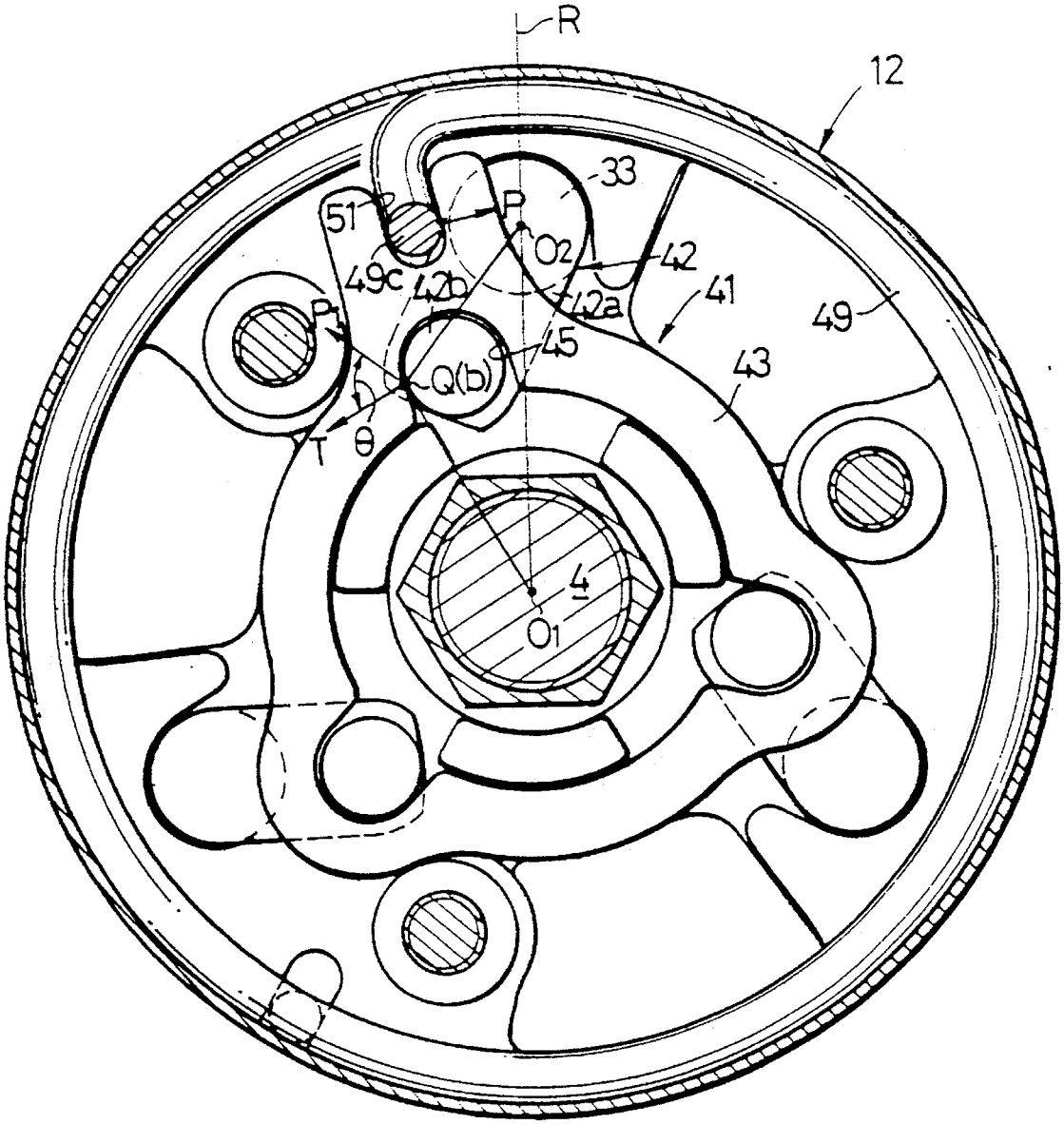

First, in FIG. 8, the return spring 49 causes the synchronizing ring 43 to be rotated clockwise about a center $O_1$ of the ring 43, and the crank 42 rotates clockwise about a center $O_2$ of the blade shaft 33 as the opening angle of the propeller blade 32 increases. An engaging point between an engaging groove 51 of the synchronizing ring 43 and the crank pin **42*b* of the crank 42 due to a load P of the return spring 49 is indicated at Q. This engaging point Q is set, at the closed position A (see FIG. 3) of the propeller blade 32, to the neighborhood of a straight line R connecting the center $O_1$ of the synchronizing ring 43 with the center $O_2$ of the blade shaft 33 as shown in FIG. 8. In the illustrated example, a position (a) which is slightly parted from the straight line R toward the load P of the return spring 49. At the opened position B (see FIG. 3) the engaging point is set to a position (b) distanced from the straight line R in a direction opposite to the former as shown in FIG. 9. Accordingly, the engaging point Q is changed from the position (a) to the position (b) by the relative sliding movement between the crank pin 42*b* and the engaging groove 45 during the rotation of the propeller blade 32** from the closed position A to the opened position B.

In the following, torque in a direction of closing the blade shaft 33, i.e., the propeller blade 32 due to the load of the return spring 49 and the like are obtained, and consideration is then made how the torque changes as the engaging point Q changes from the position a to the position b.

Figure 10:
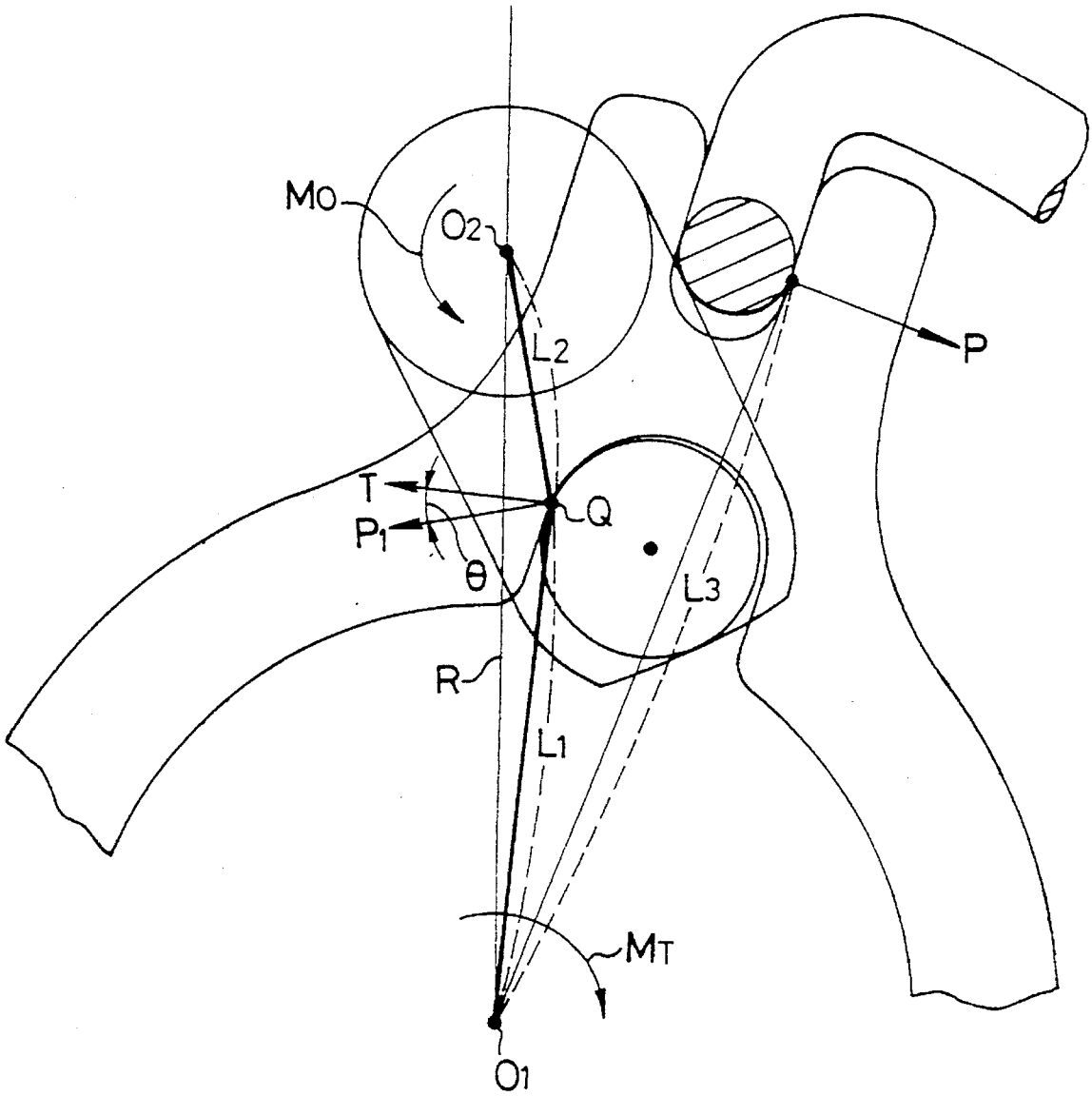
Figure 11:
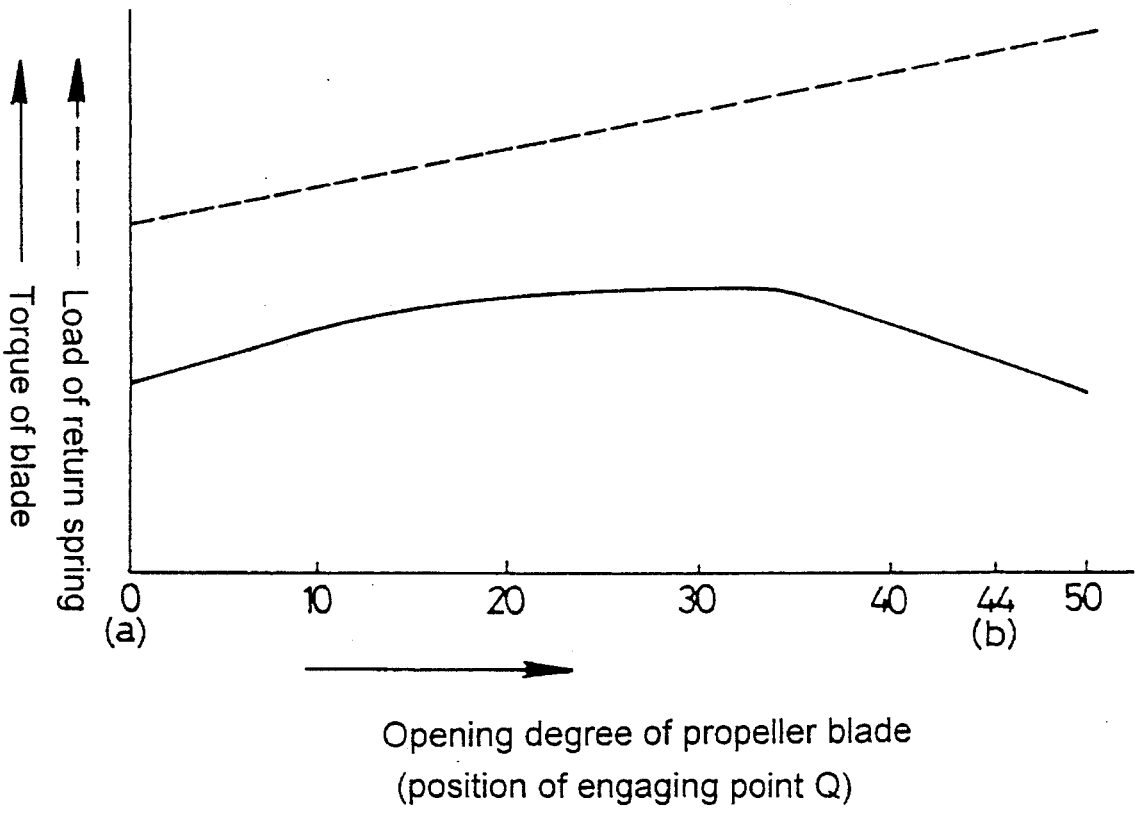

As shown in FIGS. 8 to 10, the following formulae (1) to (5) are established:

$$P_1 = M_O/L_2 \quad (1)$$

$$T = P_1/\cos\theta \quad (2)$$

$$= M_O/(L_2 \cdot \cos\theta) \quad (3)$$

$$M_T = M_O \cdot L_1/(L_2 \cdot \cos\theta) \quad (4)$$

$$P = M_O \cdot L_1/(L_2 \cdot L_3 \cdot \cos\theta) \quad (5)$$

where

P: load applied to the synchronizing ring 43 by the return spring 49;

$L_1$: arm length from the center $O_1$ of the synchronizing ring 43 to the engaging point Q $L_2$: arm length from the center $O_2$ of the blade shaft 33 to the engaging point Q;

$L_3$: arm length from the center $O_1$ of the synchronizing ring 43 to the acting point of the load P;

T: reaction force generated vertical to the arm of $L_1$ at the engaging point Q;

$P_1$: reaction force generated vertical to the arm of $L_2$ at the engaging point Q;

θ: drift angle formed by acting lines of both reaction forces T and $P_2$;

$M_T$: torque generated at the synchronizing ring 43 by the load P, and $M_O$: torque generated at the blade shaft 33 by the load P.

As will be apparent from the above formulae (3) and (4), the torque $M_O$ in a direction of closing the blade shaft 33 due to the load P of the return spring 49 is determined by $L_1/L_2$ and cos θ. The amount of change of $L_1/L_2$ is small and the amount of change of θ is large, during the change of the engaging point Q from the position (a) to the position (b) as shown in FIGS. 8 and 9. Particularly, after the engaging point Q moves beyond the straight line R, θ greatly increases. Accordingly, during that period, the load P of the return spring 49 linearly increases whereas an increase in the closed torque $M_O$ of the blade shaft 33 becomes slow. Otherwise, a reduction in torque from a certain point begins (see FIG. 11).

Generally, when the opening angle of the propeller blade 32 increases as the centrifugal force increases, an increase in the opening torque affected by the centrifugal force on the propeller blade 32 due to the movement of the center of gravity thereof becomes slow.

Accordingly, if the closing torque of the propeller blade 32 due to the load of the return spring 49 linearly increases proportional to the increase in the opening angle of the propeller blade 32, the propeller blade 32 is hard to open in the high rotational region of the propeller 5, sometimes failing to exhibit a high thrust as expected.

However, in the present invention, since the increase in the closing torque of the propeller blade 32 caused by the return spring 49 becomes slow in response to the increase in the opened angle of the propeller blade 32, as previously mentioned, the characteristics thereof are matched to that of the opening torque of the blade shaft caused by the centrifugal force, and the propeller blade 32 is opened smoothly, even in the high rotational region, according to the increase in the number of revolutions of the propeller. This positively increases the propeller-diameter D, thus exhibiting a predetermined high thrust.

Figure 12:
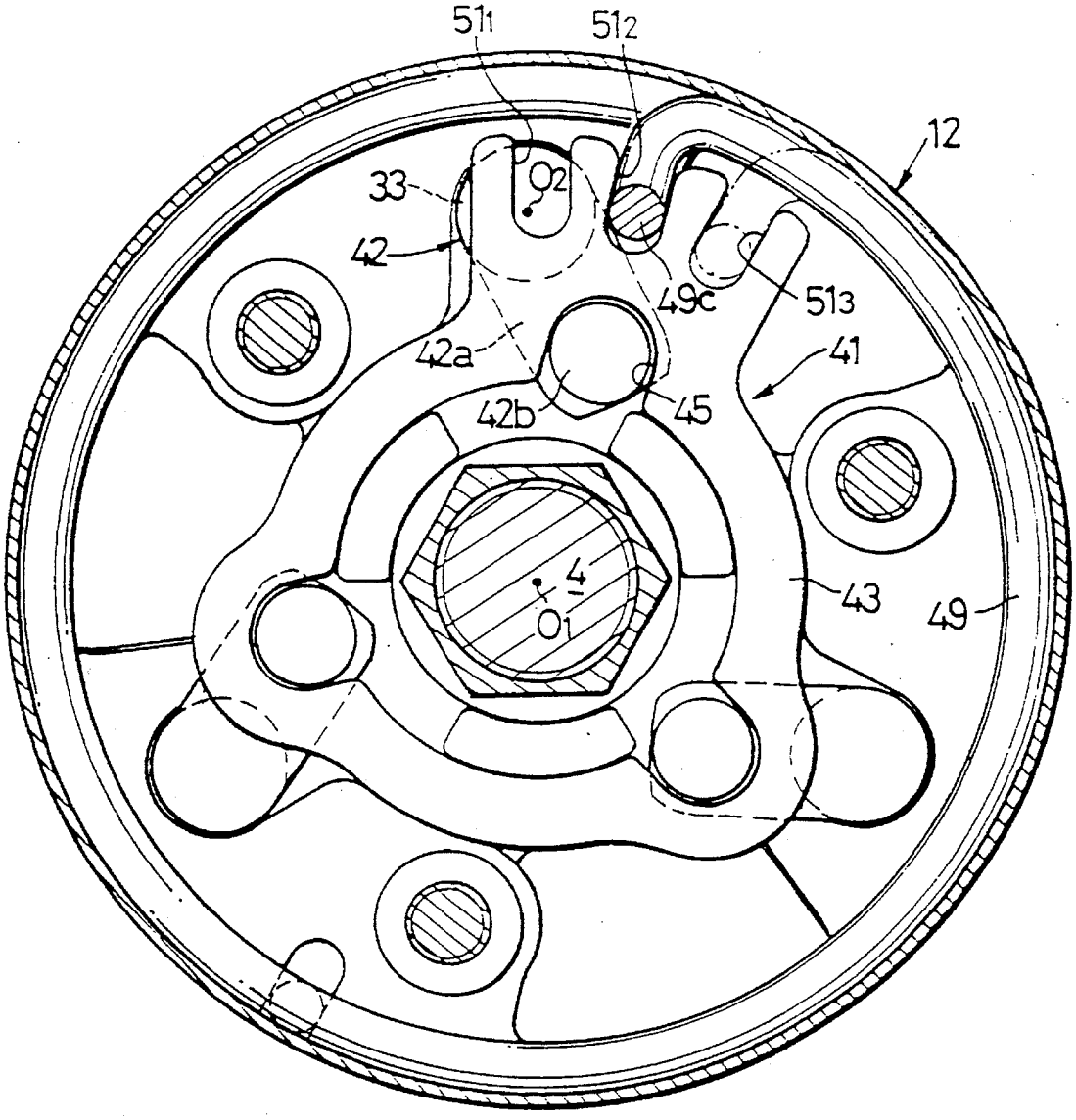
FIG. 12 is a cross-sectional view of a propeller portion corresponding to FIG. 8 showing a second embodiment of the present invention.

FIG. 12 shows a second embodiment of the present invention. This embodiment has the similar construction to that of the previous embodiment except that in the outer periphery of the synchronizing ring 43 are provided a plurality of locking grooves $\mathbf{51}_1$, $\mathbf{51}_2$ and $\mathbf{51}_3$ and one locking claw **49*c* of the return spring 49** can be selectively engaged therewith. In the drawing, parts corresponding to those of the previous embodiment are indicated by the same reference numerals.

According to this embodiment, it is possible to adjust the set load of the return spring 49, thus time for starting the opening of the propeller blade 32 (the number of revolutions of the propeller) merely by changing the stop position of the locking claw **49*c*** relative to the plurality of locking grooves $\mathbf{51}_1$, $\mathbf{51}_2$ and $\mathbf{51}_3$.

Figure 13:
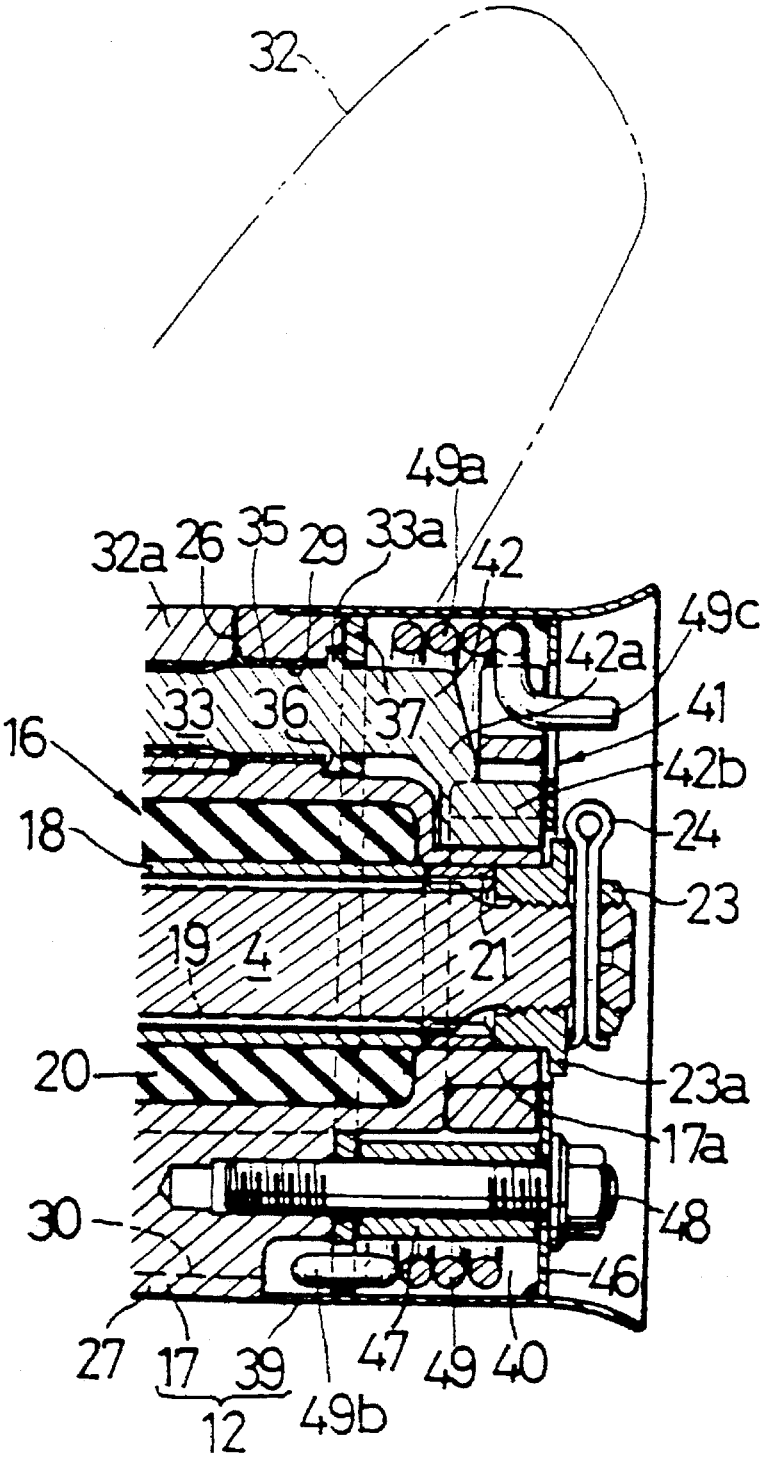
FIG. 13 is a vertical sectional view of an essential portion of a propeller showing a third embodiment of the present invention.

FIG. 13 shows a third embodiment of the present invention. In place of the thrust washer 22 in the previous embodiment, there is formed a flange **23*a* on a nut 23 for fixing a sleeve 18 and an extension collar 21 to a propeller shaft 4 so that a rearward thrust applied to a boss body 17 is received by the flange 23*a***. Other constructions are substantially the same as those of the previous embodiment. In the drawing, therefore, the parts corresponding to those of the previous embodiment are indicated by the same reference numerals as those of the previous embodiment.

Figure 14:
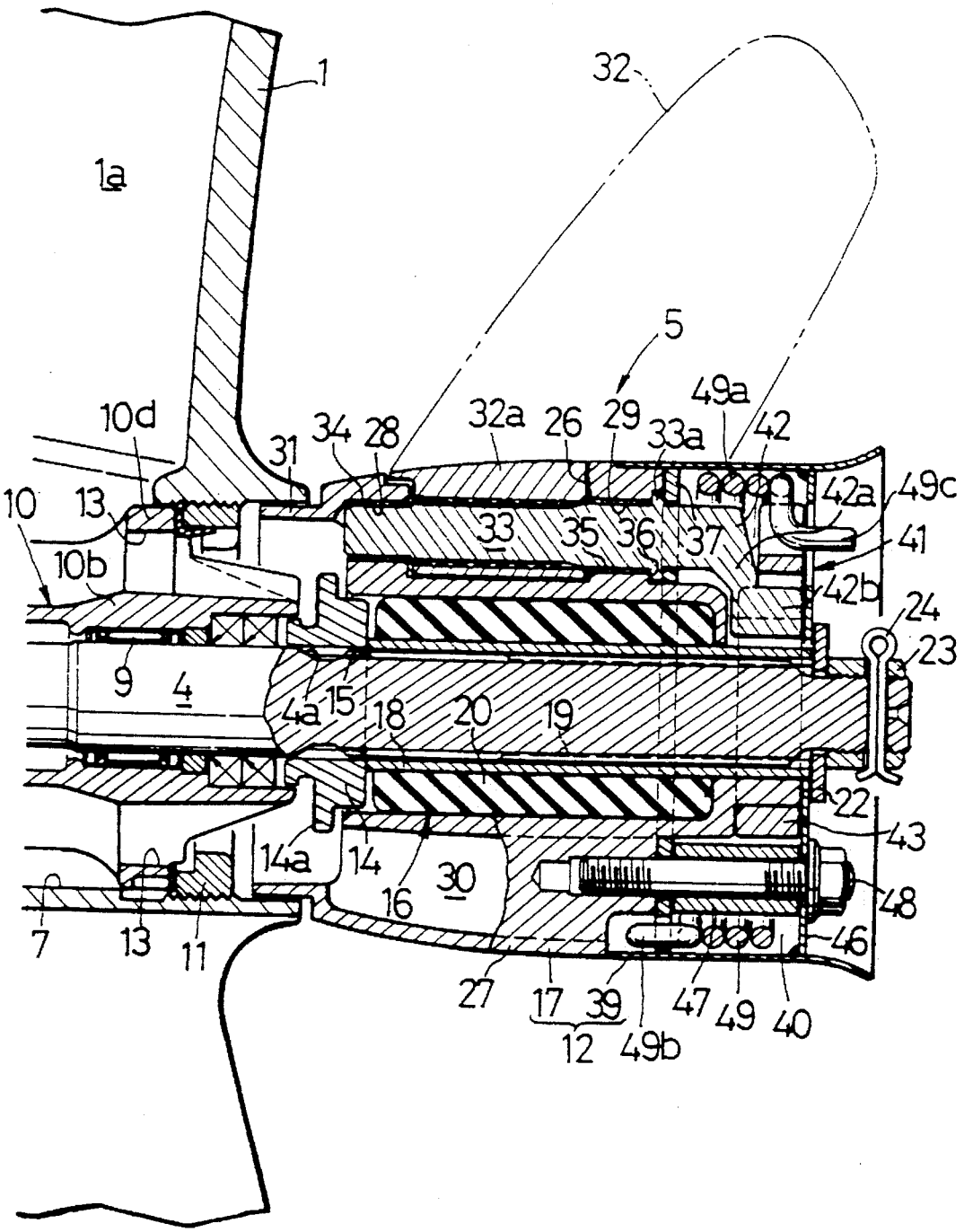
FIG. 14 is a vertical sectional view of a propeller portion showing a fourth embodiment of the present invention.
Figure 15:
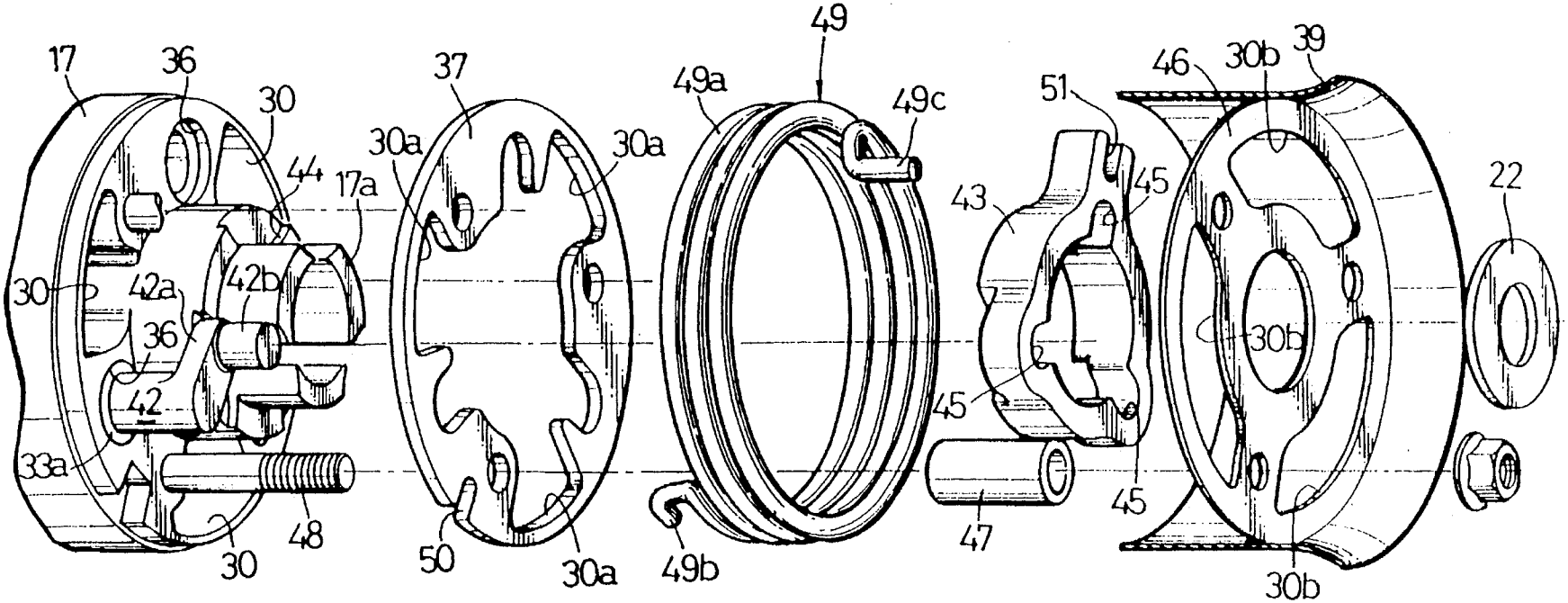
FIG. 15 is an exploded perspective view of an essential portion of a propeller.

FIGS. 14 and 15 illustrate a fourth embodiment. For removing the extension collar 21 in the previous embodiment, the rear end of the sleeve 18 is extended so as to abut with the front surface of the thrust washer 22. The rear end of the positioning boss **17*a* of the boss body 17 is carried on the thrust washer 22 through the mounting plate 46 of the diffuser pipe 39. Further, a circular cutout 44 for receiving the crank pin 42*b* of the synchronizer 41 is formed so as to reach the inner peripheral side of the positioning boss 17*a* to make the synchronizer 41** more compact. Other constructions are the same as those of the first embodiment. In the drawing, therefore, the parts corresponding to those of the first embodiment are indicated by the same reference numerals as those of the first embodiment.

Figure 16:
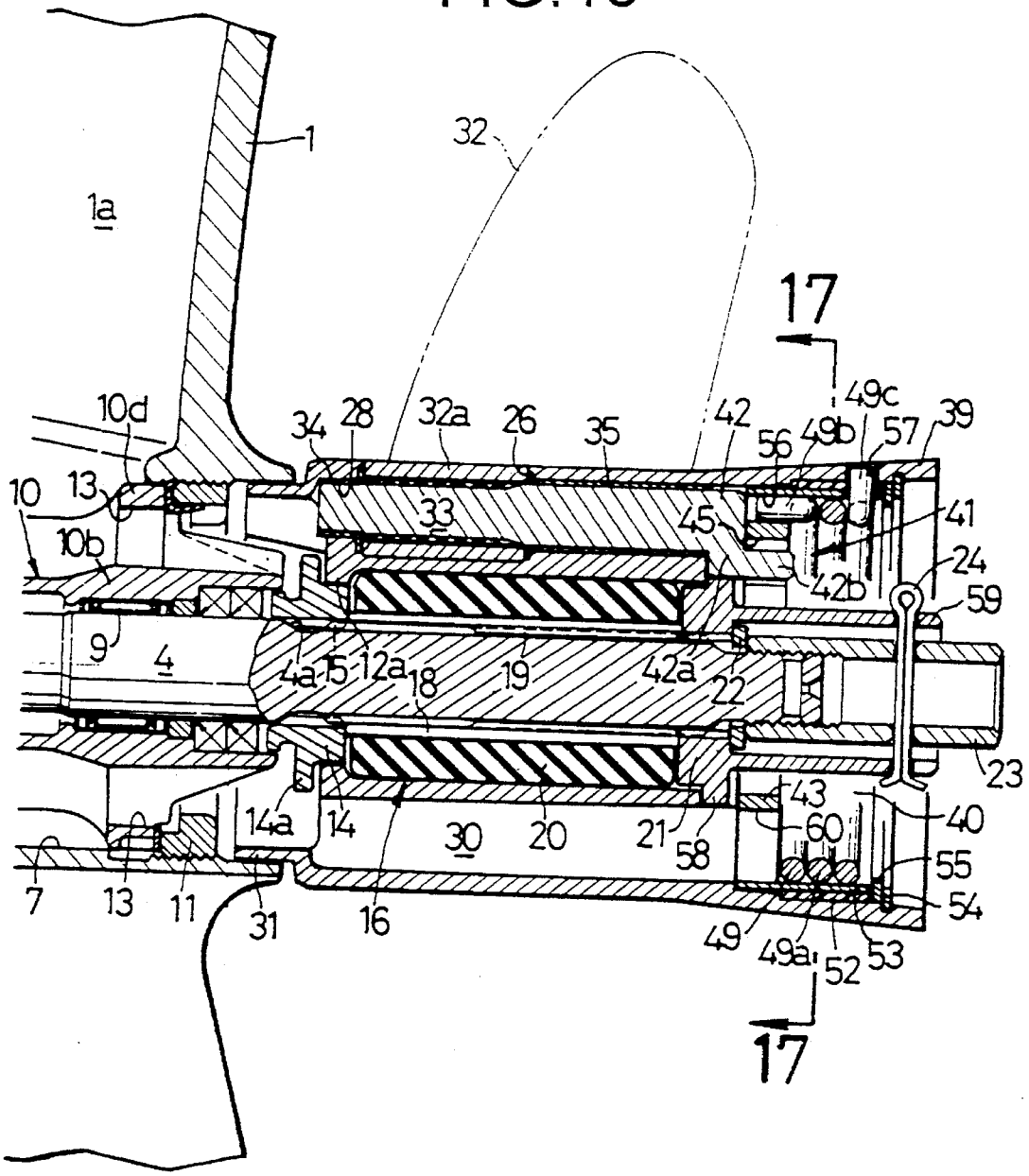
FIG. 16 is a vertical sectional view of a propeller portion showing a fifth embodiment of the present invention.
Figure 17:
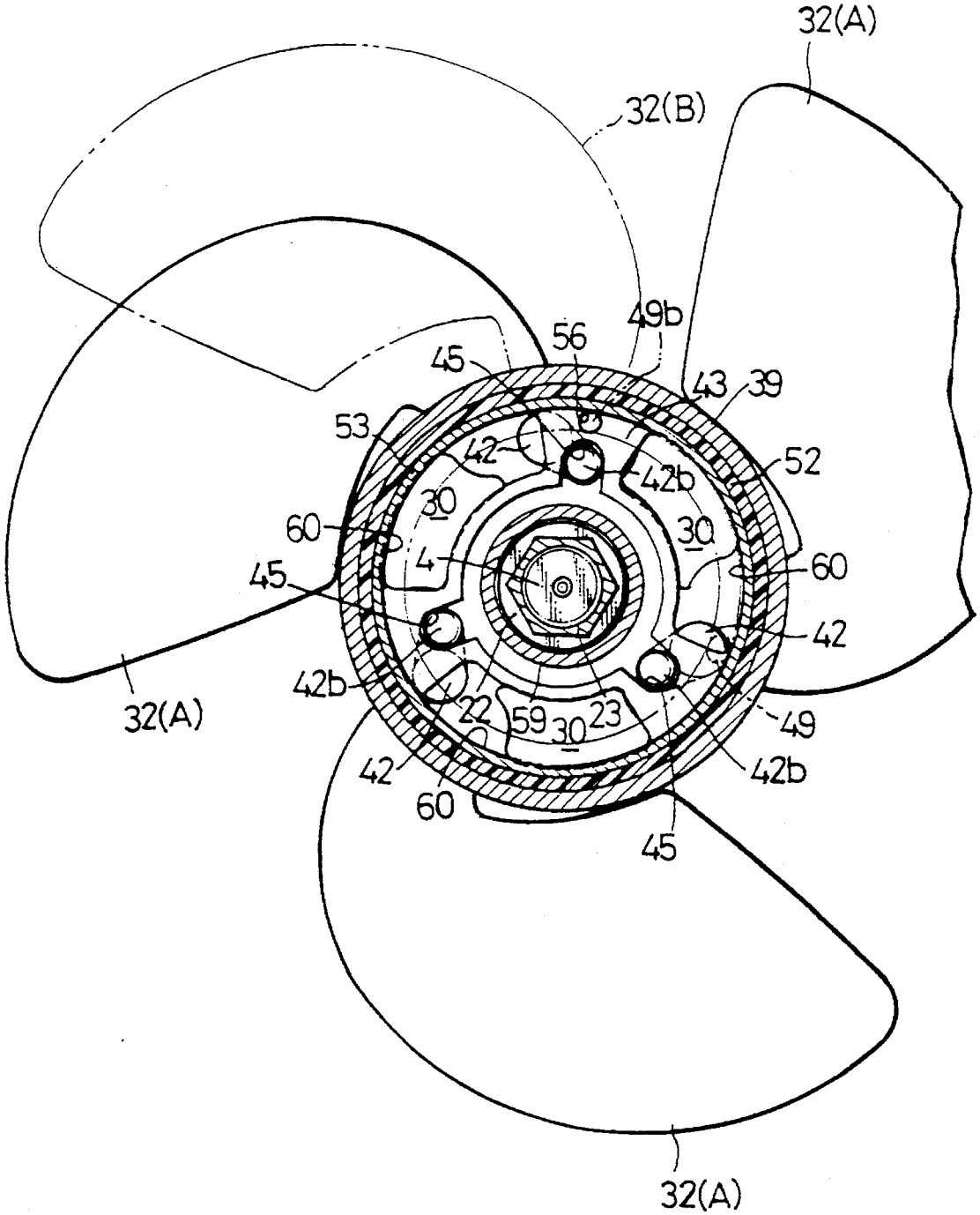
FIG. 17 is a sectional view taken along a line 17—17 shown in FIG. 16.
Figure 18:
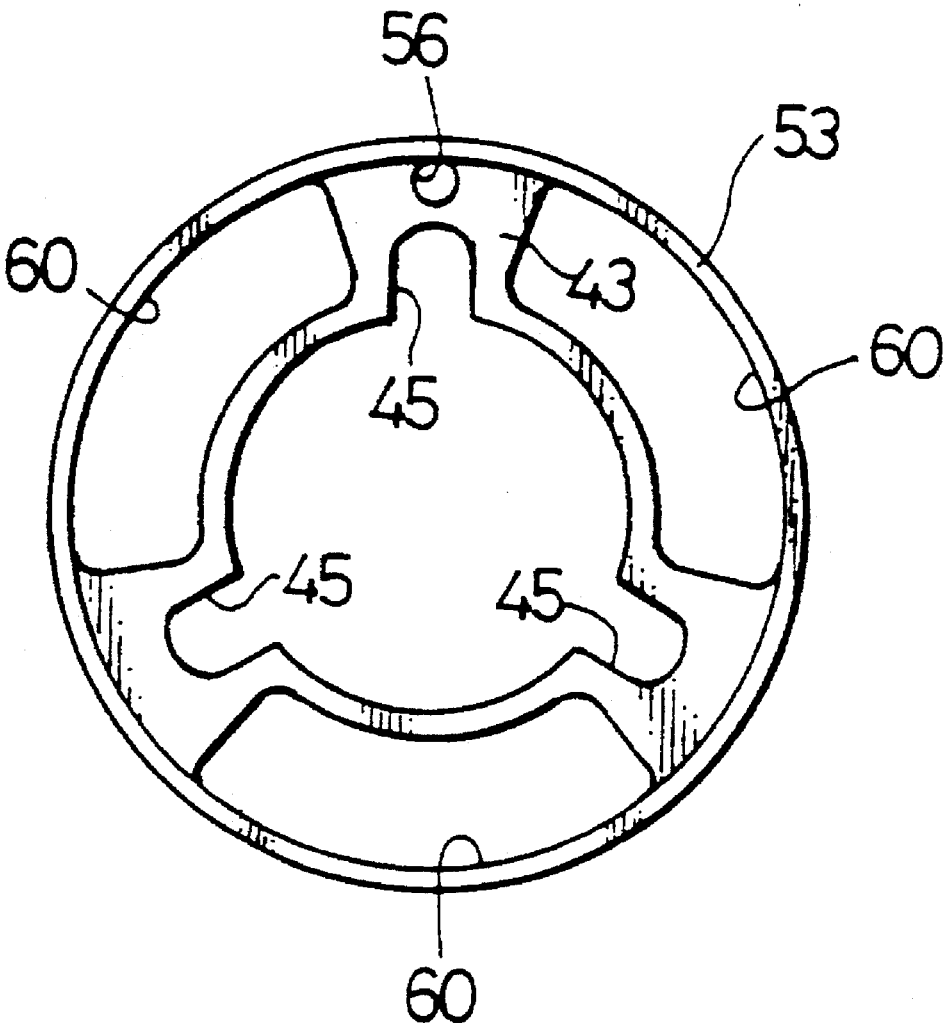
FIG. 18 is a plan view of a single synchronizing ring.

FIGS. 16 to 18 illustrate a fifth embodiment of the present invention. A propeller boss 12 is integrally provided with a diffuser pipe 39 of which the hollow portion comprises a synchronizer chamber 40. A guide tube 53 projected rearwardly from a circular synchronizing ring 43 is rotatably fitted in an inner peripheral surface of a synthetic resin bush 52 fitted to the inner peripheral surface of the diffuser pipe 39. The rear ends of the bush 52 and guide tube 53 are retained though a washer 55 by a circlip 54 stopped at the inner peripheral surface of the diffuser pipe 39. A coil portion 49*a* of a return spring 49 is disposed along the inner peripheral surface of the guide tube 53, and locking claws 49*b*, 49*b* at opposite ends thereof are engaged with locking holes 56 and 59 of the synchronizing ring 43 and the diffuser pipe 39, respectively.

The propeller boss 12 is formed at a front portion thereof with a positioning boss 12a rotatably carried on a thrust ring 14. On the other hand, an extension collar 21 carried on a thrust washer 22 is formed with a flange 58 for receiving a rearward thrust of the propeller boss 12. Further, from the extension collar 21 is projected an extension tube 59 for surrounding a long shaft nut 23 threadedly mounted on the propeller shaft 4. A cotter pin 24 is inserted into the extension tube 59 and the long shaft nut 23.

The circular synchronizing ring 43 is provided with an exhaust hole 60 matched to an exhaust passage 30 of a land portion 27.

Other constructions are substantially the same as those of the first embodiment. In the drawing, therefore, the parts corresponding to those of the first embodiment are indicated by the same reference numerals as those of the first embodiment.

In the above-described embodiments, various changes in design can be made without departing the subject matter of the present invention. For example, two or four propeller blades 32 can be used. Further, fixed propeller blades can be provided on the propeller boss 12 along with the variable propeller blades 32.

What is claimed is:

1. A variable propeller for a boat, comprising: a propeller boss fitted and connected to a propeller shaft; a plurality of blade shafts disposed along an axis of the propeller boss so as to surround said axis; and a plurality of propeller blades rotatably mounted to said propeller boss through said blade shafts so as to vary a propeller-diameter, wherein bosses for the plurality of propeller blades are connected to the plurality of blade shafts rotatably carried on the propeller boss, the propeller blades are arranged to rotate along with the blade shafts to increase the propeller-diameter in response to an increase in a centrifugal force exerting on the propeller blades, and all the blade shafts are mutually synchronously interlocked through a synchronizer comprising a crank continuously provided on one end of each of the blade shafts and a common synchronizing ring carried on the propeller boss such that the ring is engaged with a crank pin of each of the cranks to rotate about the axis of the propeller boss.

2. A variable propeller according to claim 1, further comprising a return spring connected to said synchronizing ring for rotationally biasing the plurality of propeller blades in a direction to reduce the propeller-diameter, and wherein an engaging point between said synchronizing ring and said crank pin is arranged to separate away from a straight line connecting a center of said synchronizing ring and a center of the blade shaft in accordance with an increase in an opened angle of the propeller blade.

3. A variable propeller for a boat according to claim 2, wherein said synchronizing ring is provided with a set load adjusting means for adjusting a set lead of said return spring.

4. A variable propeller for a boat according to claim 3, wherein said return spring comprises a torsional coil spring, and a coil portion of the torsional coil spring is disposed coaxially with the synchronizing ring, and both ends of the torsional coil spring are locked at said propeller boss and said synchronizing ring, respectively.

5. A variable propeller for a boat according to claim 4, wherein said synchronizing ring is provided at different peripheral positions thereof with a plurality of lock portions capable of engaging with the return spring.

6. A variable propeller for a boat according to claim 1, wherein a torque limiting device which produces a slipping upon receiving a rotational torque equal to or more than a predetermined value is interposed between said propeller shaft and said propeller boss.

7. A variable propeller for a boat according to claim 1, wherein a recess for accommodating said boss for each propeller blade is formed in an outer periphery of the propeller boss, both front and rear ends of said blade shaft for supporting said boss are carried by front and rear bearing holes provided in front and rear end walls of the recess, each of the blade shafts is formed with a flange opposed to one of axially opposite end surfaces of the propeller boss, and a common retaining plate for retaining each of the flanges in a sandwiching manner between said retaining plate and said one end surface of the propeller boss is fixedly mounted to said propeller boss.

8. A variable propeller for a boat according to claim 1, wherein a retaining plate is fixedly mounted to the propeller boss by means of a detachable fixing member.

9. A variable propeller for a boat according to claim 1, wherein said propeller boss comprises a boss body having the recesses and the front and rear bearing holes to support the blade shafts and a diffuser pipe fitted to a rear end of the boss body, and said retaining plate is fixedly mounted to the boss body by a common fixing member along with a mounting plate fixedly mounted on the diffuser pipe.

10. A variable propeller for a boat, comprising: a propeller boss fitted and connected to a propeller shaft; a plurality of blade shafts disposed along an axis of the propeller boss so as to surround said axis; and a plurality of propeller blades rotatably mounted to said propeller boss through said blade shafts so as to vary a propeller-diameter, wherein bosses for the plurality of propeller blades are connected to the plurality of blade shafts rotatably carried on the propeller boss, the propeller blades are arranged to rotate along with the blade shafts to increase the propeller-diameter in response to an increase in a centrifugal force exerting on the propeller blades, all the blade shafts are synchronously interlocked by a synchronizer, and a common return spring for biasing each of the blade shafts in a direction to reduce the propeller-diameter is connected to said synchronizer.

11. A variable propeller for a boat according to claim 10, wherein a rear end portion of said propeller boss is formed with a diffuser pipe, and a hollow portion of the diffuser pipe comprises a synchronizer chamber for accommodating said synchronizer and said return spring.

* * * * *